US009299289B2

(12) United States Patent
Park et al.

(10) Patent No.: US 9,299,289 B2
(45) Date of Patent: Mar. 29, 2016

(54) PIXEL AND ORGANIC LIGHT EMITTING DISPLAY DEVICE USING THE SAME

(71) Applicant: Samsung Display Co., Ltd., Yongin, Gyeonggi-Do (KR)

(72) Inventors: Dong-Wook Park, Yongin (KR); Chul-Kyu Kang, Yongin (KR); Keum-Nam Kim, Yongin (KR)

(73) Assignee: Samsung Display Co., Ltd., Yongin-si (KR)

( * ) Notice: Subject to any disclaimer, the term of this patent is extended or adjusted under 35 U.S.C. 154(b) by 0 days.

(21) Appl. No.: 14/571,151

(22) Filed: Dec. 15, 2014

(65) Prior Publication Data

US 2015/0097763 A1 Apr. 9, 2015

Related U.S. Application Data

(62) Division of application No. 12/900,333, filed on Oct. 7, 2010, now Pat. No. 8,941,567.

(30) Foreign Application Priority Data

Mar. 17, 2010 (KR) ..... 10-2010-0023763

(51) Int. Cl.
*G09G 3/32* (2006.01)

(52) U.S. Cl.
CPC ..... *G09G 3/3233* (2013.01); *G09G 2300/0819* (2013.01); *G09G 2300/0852* (2013.01); (Continued)

(58) Field of Classification Search
CPC ..... G09G 2300/0819; G09G 2300/0852; G09G 2300/0861; G09G 2310/0262; G09G 2320/043; G09G 3/3233; G09G 2320/04
USPC ..... 345/76–184
See application file for complete search history.

(56) References Cited

U.S. PATENT DOCUMENTS

2004/0070557 A1* 4/2004 Asano et al. ..... 345/76
2004/0080474 A1 4/2004 Kimura
(Continued)

FOREIGN PATENT DOCUMENTS

CN 101123070 A 2/2008
EP 1 887 552 A1 2/2008
(Continued)

OTHER PUBLICATIONS

European Patent Office action dated May 3, 2011. in corresponding European application No. 11157905.8, (11 pages).
(Continued)

*Primary Examiner* — Kumar Patel
*Assistant Examiner* — Insa Sadio
(74) *Attorney, Agent, or Firm* — Lewis Roca Rothgerber Christie LLP

(57) ABSTRACT

An organic light emitting display device is capable of securing sufficient compensation period such that a threshold voltage of a driving transistor may be compensated. A pixel includes: an organic light emitting diode; a second transistor for controlling an amount of current supplied from a first power source to the organic light emitting diode; a first capacitor having a first terminal coupled to a gate electrode of the second transistor; a first transistor coupled between a second terminal of the first capacitor and a data line, and being configured to turn on when a scan signal is supplied to a scan line; and a third transistor coupled between a gate electrode and a second electrode of the second transistor and having a turning-on period that is not overlapped with that of the first transistor. The third transistor is configured to turn on for a longer time than the first transistor.

8 Claims, 5 Drawing Sheets

(52) U.S. Cl.
CPC ..... *G09G2300/0861* (2013.01); *G09G 2310/0262* (2013.01); *G09G 2320/04* (2013.01); *G09G 2320/043* (2013.01)

(56) References Cited

U.S. PATENT DOCUMENTS

| | | | | |
|---|---|---|---|---|
| 2007/0085847 | A1 | 4/2007 | Shishido | |
| 2008/0036710 | A1* | 2/2008 | Kim | 345/82 |
| 2010/0033461 | A1 | 2/2010 | Hasegawa et al. | |
| 2010/0033462 | A1 | 2/2010 | Hasegawa et al. | |
| 2011/0095967 | A1 | 4/2011 | Choi | |

FOREIGN PATENT DOCUMENTS

| | | | |
|---|---|---|---|
| JP | 2003-223138 | | 8/2003 |
| JP | 2004-133240 | | 4/2004 |
| JP | 2004-286816 | | 10/2004 |
| JP | 2006-023402 | | 1/2006 |
| JP | 2007-140488 | | 6/2007 |
| JP | 2009-116115 | | 5/2009 |
| JP | 2010-039398 | | 2/2010 |
| KR | 10-2004-0033248 | | 4/2004 |
| KR | 10-2005-0109163 | | 11/2005 |
| KR | 10-2006-0023672 | | 3/2006 |
| KR | 10-2007-0003812 | A | 1/2007 |
| KR | 10-2010-0019366 | | 2/2010 |

OTHER PUBLICATIONS

Japanese Office action dated Jun. 26, 2012, for corresponding Japanese Patent application 2010-170507, (3 pages).
Japanese Office action dated Nov. 6, 2012, for corresponding Japanese Patent application 2010-170507, (3 pages).
Korean Office action dated Mar. 26, 2012 in corresponding Korean Patent Application No. 10-2010-0023763, (4 pages).
KIPO Office Action dated Aug. 12, 2011 for KR Application No. 10-2010-0023763 (5 pages).
KIPO Office action dated Oct. 30, 2012, for Korean priority Patent application 10-2010-0023763, (1 page).
SIPO Office action dated Mar. 26, 2014, for corresponding Chinese Patent application 201110041851.7, (6 pages).

* cited by examiner

PIXEL AND ORGANIC LIGHT EMITTING DISPLAY DEVICE USING THE SAME

CROSS-REFERENCE TO RELATED APPLICATION

This application is a divisional of U.S. patent application Ser. No. 12/900,333, filed Oct. 7, 2010, which claims priority to and the benefit of Korean Patent Application No. 10-2010-0023763, filed Mar. 17, 2010, the entire content of both of which is incorporated herein by reference.

BACKGROUND

1. Field

Aspects of embodiments of the present invention relate to a pixel and an organic light emitting display device using the same.

2. Description of the Related Art

Various flat panel displays (FPDs) with reduced weight and volume as compared to cathode ray tube (CRT) displays have been developed. The FPDs include a liquid crystal display (LCD), a field emission display (FED), a plasma display panel (PDP), and an organic light emitting display device.

Among the FPDs, the organic light emitting display device displays an image using organic light emitting diodes (OLED) that generate light by re-combination of electrons and holes. The organic light emitting display has a high response speed and low power consumption.

The organic light emitting display includes a plurality of pixels arranged at crossing regions of data lines, scan lines, and power lines in the form of a matrix. In general, each of the pixels includes an OLED, at least two transistors including a driving transistor, and at least one capacitor.

While the organic light emitting display device has low power consumption. However, an amount of current that flows to the OLED varies with the threshold voltage variation of the driving transistor included in each of the pixels, hence non-uniform displaying occurs. That is, properties of the driving transistor included in each of the pixels vary with the manufacturing process. Generally, it is difficult to manufacture all transistors of the organic light emitting display device to have the same properties using current manufacturing technology. Therefore, the threshold voltage variation of the driving transistors occurs.

In order to solve the above-mentioned problems, a method of adding a compensation circuit having a plurality of transistors and capacitors to respective pixels has been proposed. Each of the compensation circuits included in the respective pixels stores (or charges) a voltage corresponding to the threshold voltage of the driving transistor to compensate variation of the driving transistor.

In order to realize a 3D image, a method of driving the conventional 60 Hz period by dividing the 60 Hz period into 240 Hz periods has been proposed. However, in the case of the high speed driving higher than 240 Hz, the charging period of the threshold voltage of the driving transistor becomes shorter, and therefore it is not possible or very difficult to compensate for the threshold voltage of the driving transistor.

SUMMARY

Accordingly, aspects of embodiments according to the present invention are directed toward a pixel capable of sufficiently securing a compensating period of a threshold voltage and an organic light emitting display device using the same.

In order to achieve the foregoing and/or other aspects of the present invention, according to an embodiment of the present invention, there is provided a pixel including: an organic light emitting diode having a cathode electrode coupled to a second power source; a second transistor for controlling an amount of current supplied from a first power source to the organic light emitting diode, the first power source being coupled to a first electrode of the second transistor; a first capacitor having a first terminal coupled to a gate electrode of the second transistor; a first transistor coupled between a second terminal of the first capacitor and a data line, the first transistor being configured to turn on when a scan signal is supplied to a scan line; and a third transistor coupled between a gate electrode and a second electrode of the second transistor, the third transistor being configured to have a turning-on period that is not overlapped with that of the first transistor, wherein the third transistor is configured to turn on for a longer time than the first transistor.

The pixel may further include a fourth transistor coupled between a reference power source and the second terminal of the first capacitor, the fourth transistor and the third transistor being configured to turn on and off at a same time; and a fifth transistor coupled between the second electrode of the second transistor and the organic light emitting diode, the fifth transistor being configured to have a turning-on period partially overlapped with that of the third transistor. The turning-on period of the first transistor may be overlapped with that of the fifth transistor. The first transistor may be configured to turn on after the fifth transistor is turned off. The fifth transistor may be configured to turn on after the third transistor is turned on. A turning-on period of the fifth transistor may be overlapped with a turning-on period of the third transistor for a period exceeding one horizontal period. The fifth transistor and the third transistor may be configured to turn on for a period longer than three horizontal periods.

In order to achieve the foregoing and/or other aspects of the present invention, according to an embodiment of the present invention, there is provided an organic light emitting display device including: a scan driver for sequentially supplying scan signals to scan lines and for sequentially supplying light emission control signals to light emission control lines; a control line driver for sequentially supplying control signals to control lines, each of the control signals having a duration longer than that of a corresponding one of the scan signals; a data driver for supplying data signals to data lines, the data signals being synchronized with the scan signals; and pixels at crossing regions of the scan lines and the data lines; wherein an $i^{th}$ pixel of the pixels includes: an organic light emitting diode having a cathode electrode coupled to a second power source; a second transistor for controlling an amount of current supplied from a first power source to the organic light emitting diode, the first power source being coupled to a first electrode of the second transistor; a first capacitor having a first terminal coupled to a gate electrode of the second transistor; a first transistor coupled between a second terminal of the first capacitor and a data line of the data lines, the first transistor being configured to turn on when a scan signal of the scan signals is supplied to an $i^{th}$ scan line of the scan lines; and a third transistor coupled between a gate electrode and a second electrode of the second transistor, the third transistor being configured to turn on when a control signal of the control signals is supplied to an $i^{th}$ control line of the control lines, wherein the control signal supplied to the $i^{th}$ control line is supplied before the scan signal is supplied to the $i^{th}$ scan line such that the control signal supplied to the $i^{th}$ control line is not overlapped with the scan signal supplied to the $i^{th}$ scan line.

The scan driver may be configured to supply a light emission control signal of the light emission control signals to the $i^{th}$ light emission control line of the light emission control lines, the light emission control signal being partially overlapped with the control signal and having the same duration as that of the control signal. The light emission control signal supplied to the $i^{th}$ light emission control line may be overlapped with the control signal supplied to the $i^{th}$ control line for a period exceeding one horizontal period. Each of the light emission control signal and the control signal may have a duration longer than three horizontal periods. The organic light emitting display device may further include: a fourth transistor coupled between a reference power source and the first capacitor, the fourth transistor being configured to turn on when the control signal is supplied to the $i^{th}$ control line; a fifth transistor coupled between the second electrode of the second transistor and the organic light emitting diode, the fifth transistor being configured to turn off when the light emission control signal is supplied to the $i^{th}$ light emission control line; and a second capacitor coupled between the second terminal of the first capacitor and the first power source.

In order to achieve the foregoing and/or other aspects of the present invention, according to another embodiment of the present invention, there is provided an organic light emitting display device including: a scan driver for sequentially supplying scan signals to scan lines and for sequentially supplying light emission control signals to light emission control lines, each of the scan signals having a duration longer than k horizontal periods and each of the emission control signals having a duration longer than that of a corresponding one of the scan signals; a data driver for supplying data signals to data lines, the data signals being synchronized with the scan signals; and pixels at crossing regions of the scan lines and the data lines; wherein an $i^{th}$ pixel of the pixels includes: an organic light emitting diode having a cathode electrode coupled to a second power source; a second transistor for controlling an amount of current flowing from a first power source to the organic light emitting diode, the first power source being coupled to a first electrode of the second transistor; a first capacitor having a first terminal coupled to a gate electrode of the second transistor; a first transistor coupled between a second terminal of the first capacitor and the data line, the first transistor being configured to turn on when a first scan signal of the scan signals is supplied to an $i^{th}$ scan line of the scan lines; a third transistor coupled between a gate electrode and a second electrode of the second transistor, the third transistor being configured to turn on when a second scan signal of the scan signals is supplied to an $(i-k)^{th}$ scan line of the scan lines; and a fifth transistor coupled between the second electrode of the second transistor and the organic light emitting diode, the fifth transistor being configured to turn off when a light emission control signal of the light emission control signals is supplied to an $i^{th}$ light emission control line of the light emission control lines, wherein the light emission control signal supplied to the $i^{th}$ light emission control line is partially overlapped with the second scan signal supplied to the $(i-k)^{th}$ scan line and is completely overlapped with the first scan signal supplied to the $i^{th}$ scan line.

The organic light emitting display device may further include: a fourth transistor coupled between a reference power source and the second terminal of the first capacitor, the fourth transistor being configured to turn on when a control signal is supplied to the $i^{th}$ control line; and a second capacitor coupled between the second terminal of the first capacitor and the first power source.

According to the organic light emitting display device of the present invention, the threshold voltage of the driving transistor can be compensated for in a period exceeding one horizontal period, and therefore an image with desired brightness can be displayed.

BRIEF DESCRIPTION OF THE DRAWINGS

The accompanying drawings, together with the specification, illustrate exemplary embodiments of the present invention, and, together with the description, serve to explain the principles of the present invention.

DETAILED DESCRIPTION

Figure 1:
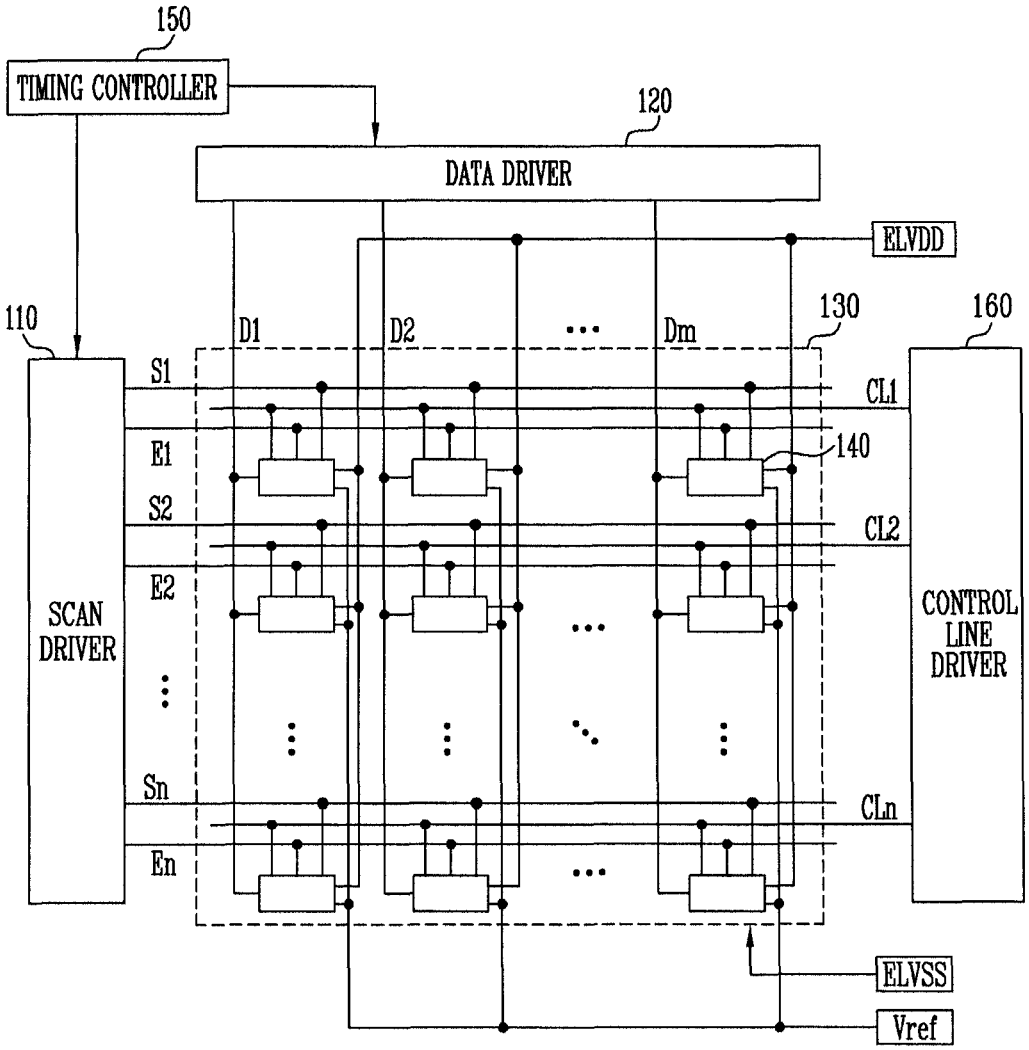
FIG. 1 is a schematic block diagram illustrating an organic light emitting display device according to an embodiment of the present invention.

Hereinafter, certain exemplary embodiments according to the present invention will be described with reference to the accompanying drawings. Here, when a first element is described as being coupled or connected to a second element, the first element may be directly coupled to the second element or indirectly coupled to the second element via one or more third elements. Further, some of the elements that are not essential to a complete understanding of the invention are omitted for clarity. Also, like reference numerals refer to like elements throughout.

Hereinafter, embodiments will be described in detail with reference to FIGS. 1 to 9.

FIG. 1 is a schematic block diagram illustrating an organic light emitting display device according to an embodiment of the present invention.

Referring to FIG. 1, the organic light emitting display device includes pixels 140 positioned at crossing regions of scan lines S1 to Sn, light emission control lines E1 to En, control lines CL1 to CLn, and data lines D1 to Dm; a display unit 130 including the pixels 140 that are arranged in the form of a matrix; a scan driver 110 for driving the scan lines S1 to Sn and the light emission control lines E1 to En; a data driver 120 for driving the data lines D1 to Dm; a control line driver 160 for driving the control lines CL1 to CLn; and a timing controller 150 for controlling the scan driver 110, the data driver 120, and the control line driver 160.

The control line driver 160 sequentially supplies control signals to the control lines CL1 to CLn. Here, a control signal supplied to an $i^{th}$ control line CLi (i is a natural number) is not overlapped with a scan signal supplied to an $i^{th}$ scan line Si. For example, the control signal supplied to the $i^{th}$ control line CLi is supplied before the scan signal is supplied to the $i^{th}$ scan line Si. The pixels 140 receive the control signals and store a voltage corresponding to a threshold voltage of driving transistors for a part of a period when the control signals are supplied. The control line driver 160 supplies control signals having a duration longer than three horizontal periods 3H such that the threshold voltage of the driving transistors included in the respective pixels 140 can be stably compensated.

The scan driver 110 sequentially supplies scan signals to the scan lines S1 to Sn and light emission control signals to the light emission control lines E1 to En. Here, a light emission control signal supplied to an $i^{th}$ light emission control line Ei is overlapped with the scan signal supplied to an $i^{th}$ scan line Si. The light emission control signal supplied to the $i^{th}$ light emission control line Ei is set to have the same duration as that of the control signal and is overlapped with the control signal supplied to an $i^{th}$ control line CLi in a partial period. For example, the light emission control signal supplied to the $i^{th}$ light emission control line Ei is overlapped with the control signal supplied to the $i^{th}$ control line CLi for the remaining period except for the period when the light emission control signal is overlapped with the scan signal. That is, the light emission control signal and the control signal partially overlap. Here, the control signal and the scan signal are set to a suitable voltage for turning on the transistors included in the pixels 140, and the light emission control signal is set to a suitable voltage for turning off the transistors included in the pixels 140.

The data driver 120 supplies data signals to the data lines D1 to Dm to be synchronized with the scan signals. Here, the data driver 120 supplies left data, black data, and right data at different time such that a 3D image can be displayed in the display unit 130. This will be described later in more detail.

The timing controller 150 controls the scan driver 110, the data driver 120, and the control line driver 160 in response to the synchronization signal that is supplied from the outside.

The display unit 130 includes the pixels 140 formed at the crossing regions of the scan lines S1 to Sn and the data lines D1 to Dm. The pixels 140 receive a first power source ELVDD, a second power source ELVSS, and a reference power source Vref from the outside. The pixels 140 control the amount of current flowing from the first power source ELVDD to the second power source ELVSS via the OLED included in each of the pixels 140 in response to the data signals.

Figure 2:
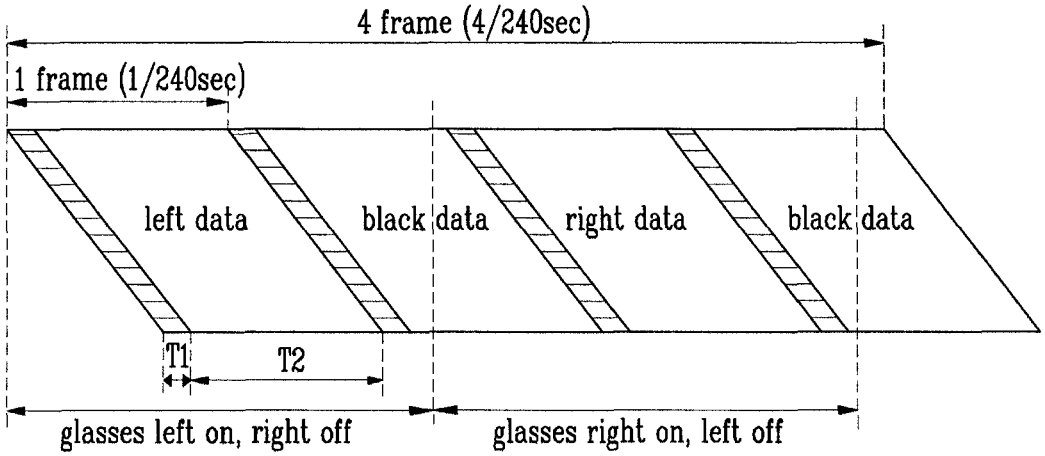
FIG. 2 is a diagram illustrating a driving method according to an embodiment of the present invention.

FIG. 2 is a diagram illustrating a driving method according to an embodiment of the present invention.

Referring to FIG. 2, in 240 Hz driving, one frame corresponds to 1/240 seconds (approximately 4.167 ms), and in 60 Hz driving, one frame corresponds to 1/60 second (approximately 16.67 ms). That is, one 60 Hz frame may be divided into four frames in 240 Hz driving. In FIG. 2, a period corresponding to one frame is divided into a first period T1 and a second period T2.

The pixels 140 are set to non-light emission state for the first period T1 while the threshold voltages of the driving transistors that are included in the respective pixels 140 are compensated for. In addition, voltages corresponding to the data signals may be stored at the respective pixels 140 for the first period T1.

The respective pixels 140 generate light with brightness corresponding to the voltages of the data signals, which are stored for an early period of the first period T1 or the second period T2, for the second period T2.

In FIG. 2, the left data, the black data, the right data, and the black data are sequentially supplied for four frame periods. In other words, one frame period of 60 Hz driving is divided into four frame periods of 240 Hz driving. The left data is supplied to the respective pixels 140 for a first frame period of the four frame periods, and the black data is supplied to the respective pixels 140 for the second frame period. The right data is supplied to the respective pixels 140 for the third frame period, and the black data is supplied to the respective pixels 140 for the fourth frame period.

Here, light is supplied to the left-side lens of glasses for the period when the left data is supplied, and is supplied to the right-side lens of the glasses for the period when the right data is supplied. In this case, a user wearing such glasses may perceive a 3D image displayed on the display unit 130 corresponding to the light alternately supplied to the left-side and right-side lenses of the glasses.

In FIG. 2, the black data is supplied between the left data and the right data. When the black data is supplied for one frame between the left data and the right data, the glasses is operated such that two operations, of which the left-side lens on/the right-side lens off and the left-sided lens off/the right-sided lens on, alternate without an overall off period (e.g., both left/right sides off) so that it is possible to prevent the images of the left data and the right data from being overlapped and perceived by the user.

Figure 3:
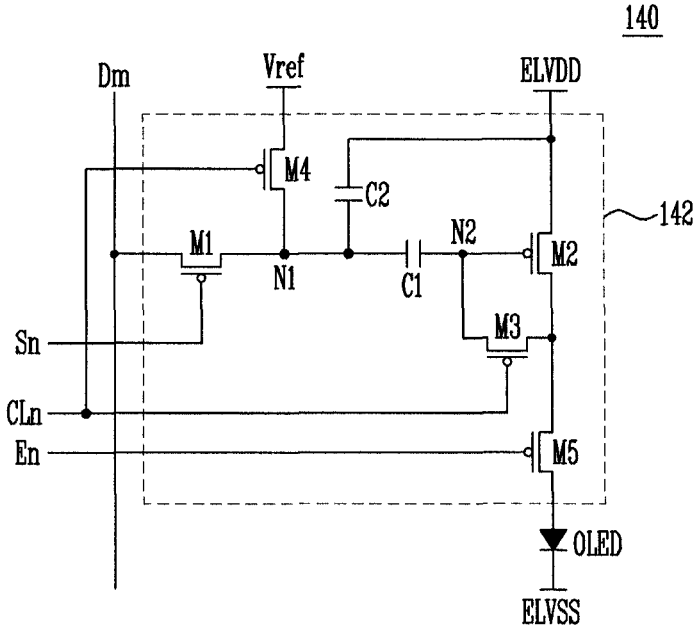
FIG. 3 is a circuit diagram illustrating a pixel according to a first embodiment of the present invention.

FIG. 3 is a circuit diagram illustrating a pixel according to a first embodiment of the present invention. For example, the pixel coupled to the $n^{th}$ scan line Sn and the $m^{th}$ data line Dm will be illustrated.

Referring to FIG. 3, the pixel 140 according to the first embodiment of the present invention includes an organic light emitting diode OLED and a pixel circuit 142 for controlling an amount of current supplied to the OLED.

The OLED generates light with brightness corresponding to the current supplied from the pixel circuit 142. For example, the OLED generates red, green, or blue light with brightness corresponding to the amount of current supplied from the pixel circuit 142.

The pixel circuit 142 receives a data signal when the scan signal is supplied to the scan line Sn, and stores a voltage corresponding to the threshold voltage of the second transistor M2 (e.g., a driving transistor) for a period when the control signal, supplied to the control line CLn, and the light emission control signal, supplied to the light emission control line En, are overlapped with each other. To this end, the pixel circuit 142 includes first, second, third, fourth, and fifth transistors M1 to M5, a first capacitor C1, and a second capacitor C2.

A first electrode of the first transistor M1 is coupled to the data line Dm, and a second electrode of the first transistor M1 is coupled to the first node N1. A gate electrode of the first transistor M1 is coupled to the scan line Sn. The first transistor M1 is turned on to electrically couple the data line Dm to the first node N1 when the scan signal is supplied to the scan line Sn.

A first electrode of the second transistor M2 is coupled to the first power source ELVDD, and a second electrode of the second transistor M2 is coupled to the first electrode of the fifth transistor M5. A gate electrode of the second transistor M2 is coupled to the second node N2. The second transistor M2 supplies a current corresponding to a voltage supplied to the second node N2 to the first electrode of the fifth transistor M5.

A second electrode of the third transistor M3 is coupled to the second node N2, and a first electrode of the third transistor M3 is coupled to the second electrode of the second transistor M2. A gate electrode of the third transistor M3 is coupled to the control line CLn. The third transistor M3 is turned on to couple the second transistor M2 in the form of a diode (e.g., diode-connected) when the control signal is supplied to the control line CLn.

A first electrode of the fourth transistor M4 is coupled to the reference power source Vref, and a second electrode of the fourth transistor M4 is coupled to the first node N1. A gate electrode of the fourth transistor M4 is coupled to the control line CLn. The fourth transistor M4 is turned on to supply the voltage of the reference power source Vref to the first node N1 when the control signal is supplied.

The first electrode of the fifth transistor M5 is coupled to the second electrode of the second transistor M2, and a second electrode of the fifth transistor M5 is coupled to an anode electrode of the OLED. A gate electrode of the fifth transistor M5 is coupled to the light emission control line En. The fifth transistor M5 is turned off when the light emitting control signal (e.g., a high level voltage) is supplied to the light emission control line En and turned on when the light emitting control signal is not supplied (e.g., a low level voltage).

The first capacitor C1 is coupled between the first node N1 and the second node N2. The first capacitor C1 stores a voltage between the first node N1 and the second node N2. For example, the first capacitor C1 stores the voltage corresponding to the threshold voltage of the second transistor M2.

The second capacitor C2 is coupled between the first node N1 and the first power source ELVDD. The second capacitor C2 stores a voltage between the first node N1 and the first power source ELVDD. For example, the second capacitor C2 stores the voltage corresponding to the data signal.

Figure 4:
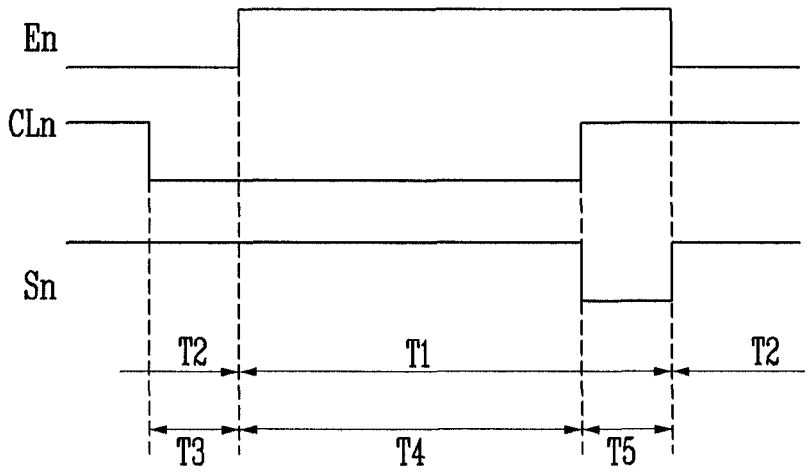
FIGS. 4 and 5 are timing diagrams illustrating the driving method of FIG. 2.

FIG. 4 is a timing diagram illustrating a first embodiment of the driving method of the pixel of FIG. 3. In FIG. 4, the first period T1 of FIG. 2 is divided into a fourth period T4 and a fifth period T5. A period immediately before the first period T1 (for example, one horizontal period 1H) is a third period T3.

Referring to FIG. 4, the control signal is supplied to the control line CLn for the third period T3. When the control signal (e.g., a low level voltage) is supplied to the control line CLn, the fourth transistor M4 and the third transistor M3 are turned on.

When the fourth transistor M4 is turned on, the voltage of the reference power source Vref is supplied to the first node N1. When the third transistor M3 is turned on, the second transistor M2 is coupled in the form of a diode. Here, since the fifth transistor M5 maintains the turned-on state for the third period T3, the voltage of the second node N2 is initialized to approximately the voltage of the second power source ELVSS.

The light emission control signal (e.g., a high level voltage) is supplied to the light emission control line En for the fourth period T4 such that the fifth transistor M5 is turned off. When the fifth transistor M5 is turned off, the electrical coupling between the second node N2 and the OLED is interrupted. In this case, a voltage in which the threshold voltage of the second transistor M2 is subtracted from the first power source ELVDD is applied to the second node N2 by the second transistor M2 that is coupled in the form of a diode. At this time, the first capacitor C1 stores the voltage corresponding to a voltage difference between the first node N1 and the second node N2, that is, the threshold voltage of the second transistor M2.

The duration of the fourth period T4 is set to a suitable duration to stably store the voltage corresponding to the threshold voltage of the second transistor M2 at the first capacitor C1. In other words, durations of the control signal and the light emission control signal are set longer than three horizontal periods 3H so that the compensation period T4 of the threshold voltage can be sufficiently set. For example, the durations of the control signal and the light emission control signal are controlled such that the fourth period T4 is set to as a period exceeding 1H.

In the fifth period T5, the supply of the control signal to the control line CLn is stopped, and the scan signal is supplied to the scan line Sn. When the supply of the control signal to the control line CLn is stopped, the fourth transistor M4 is turned off. When the scan signal is supplied to the scan line Sn, the first transistor M1 is turned on.

When the first transistor M1 is turned on, the data signal is supplied from the data line Dm to the first node N1. At this time, the voltage of the first node N1 is lowered down from the voltage of the reference power source Vref to the voltage of the data signal, and the second capacitor C2 stores the voltage corresponding to the data signal.

After that, the light emission control signal is not supplied to the light emission control line En for the second period T2, and the fifth transistor M5 is turned on. When the fifth transistor M5 is turned on, the second transistor M2 supplies the current corresponding to the voltages stored at the first and second capacitors C1 and C2 to the OLED.

Figure 5:
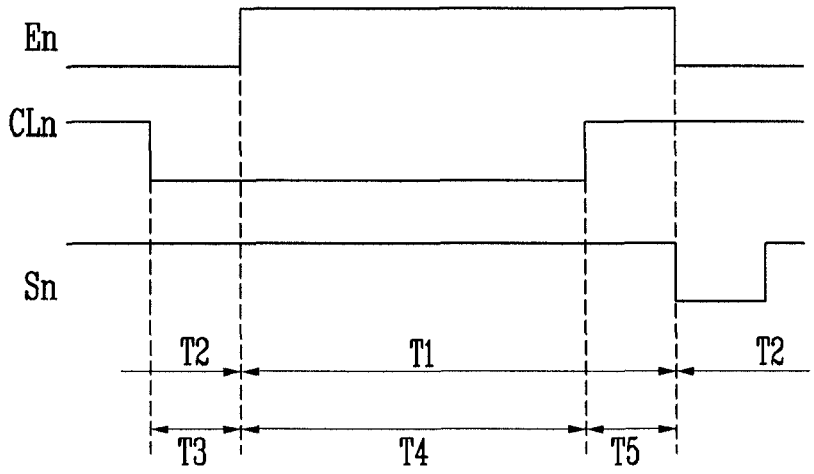

Here, according to an embodiment of the present invention, the scan signal, as illustrated in FIG. 5, may be supplied after the supply of the light emission control signal to the light emission control line En is stopped. That is, since the data signal is supplied to the first node N1, the voltage corresponding to the data signal can be stably stored at the second capacitor C2 regardless of the turning-on/off of the fifth transistor M5.

Figure 6:
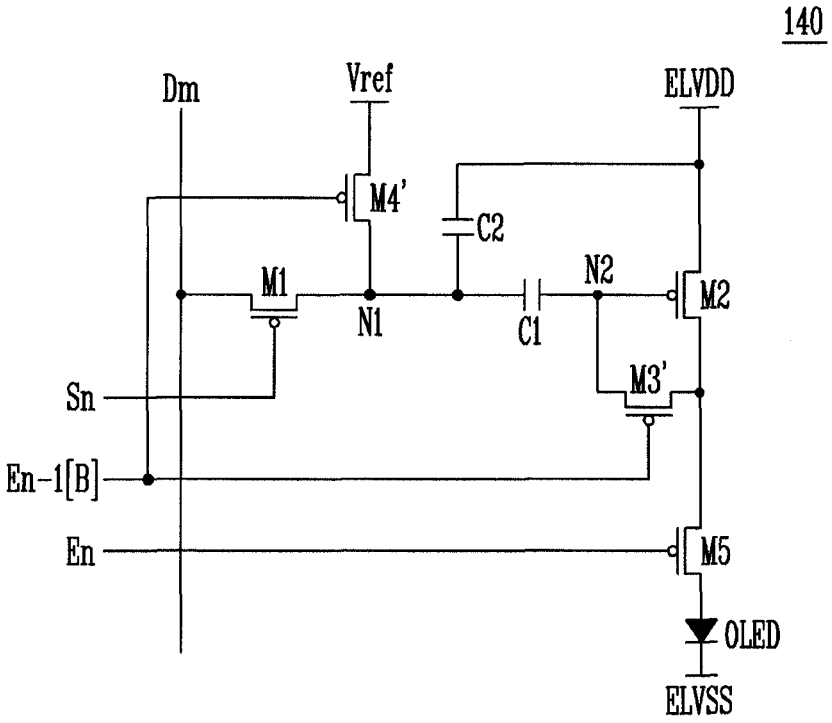
FIG. 6 is a circuit diagram illustrating a pixel according to a second embodiment of the present invention.

FIG. 6 is a circuit diagram illustrating a pixel according to a second embodiment of the present invention. In the description with reference to FIG. 6, same reference numerals are assigned to the same elements as those in FIG. 3, and description thereof will be omitted.

Referring to FIG. 6, a second electrode of a third transistor M3' is coupled to the second node N2, and a first electrode of the third transistor M3' is coupled to the second electrode of the second transistor M2. A gate electrode of the third transistor M3' is coupled to an $(n-1)^{th}$ reverse light emission control line En−1[B]. Here, a reverse light emission control signal supplied to the $(n-1)^{th}$ reverse light emission control line En−1[B] is set to have the same supplying time and duration and a reversed polarity of the light emission control signal supplied to the $(n-1)^{th}$ light emission control line En−1.

A first electrode of a fourth transistor M4' is coupled to the reference power source Vref, and a second electrode of the fourth transistor M4' is coupled to the first node N1. A gate electrode of the fourth transistor M4' is coupled to the $(n-1)^{th}$ reverse light emission control line En−1[B].

Figure 7:
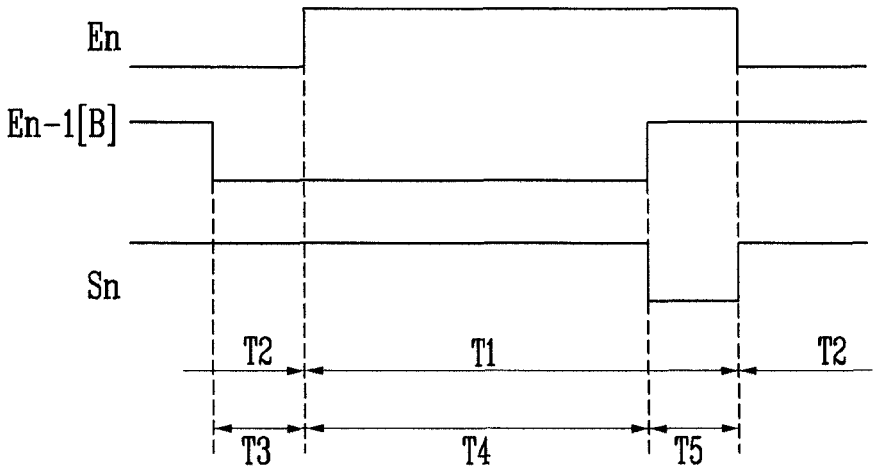
FIG. 7 is a timing diagram illustrating a method of driving the pixel of FIG. 6.

Here, as illustrated in FIG. 7, the reverse light emission control signal supplied to the $(n-1)^{th}$ light emission control line En−1[B] is set to have the same supplying time and duration as those of the control signal of FIG. 4. The reverse light emission control signal may be supplied from the scan driver 110 by reversing the light emission control signal, and manufacturing costs can be reduced in comparison to the pixel of FIG. 3.

Figure 8:
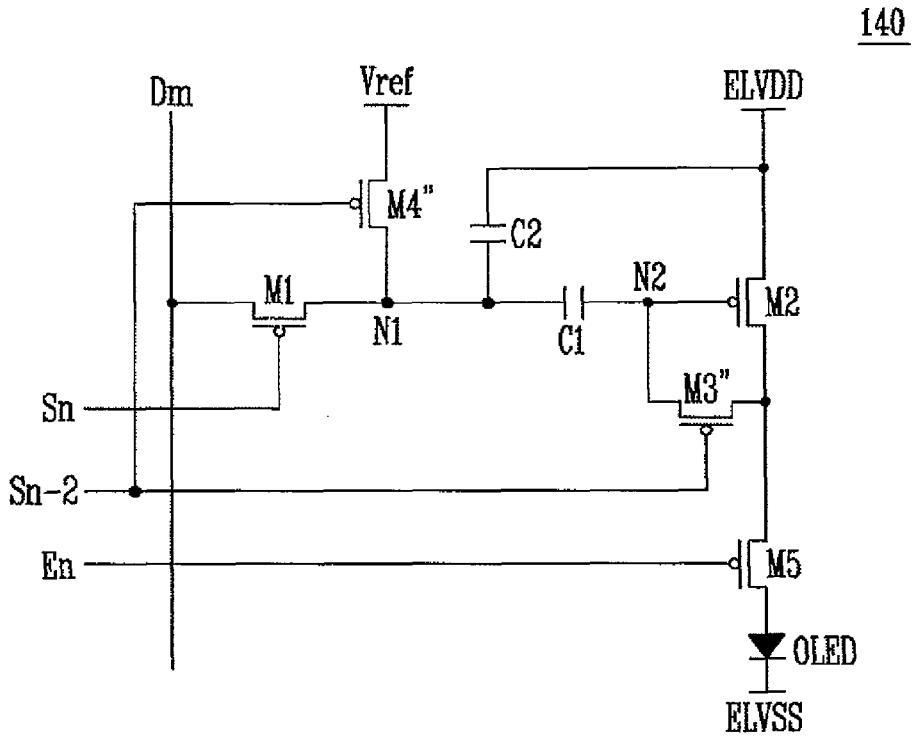
FIG. 8 is a circuit diagram illustrating a pixel according to a third embodiment of the present invention.

FIG. 8 is a circuit diagram illustrating a pixel according to a third embodiment of the present invention. In the description with reference to FIG. 8, same reference numerals are assigned to the same elements as those in FIG. 3, and description thereof will be omitted.

Referring FIG. 8, a second electrode of a third transistor M3" is coupled to the second node N2, and a first electrode of the third transistor M3" is coupled to the second electrode of the second transistor M2. A gate electrode of the third transistor M3" is coupled to an $(n-2)^{th}$ scan line Sn−2. The third transistor M3" is turned on when the scan signal is supplied to the $(n-2)^{th}$ scan line Sn−2.

A first electrode of a fourth transistor M4" is coupled to the reference power source Vref, and a second electrode of the fourth transistor M4" is coupled to the first node N1. A gate electrode of the fourth transistor M4" is coupled to the $(n-2)^{th}$ scan line Sn−2. The fourth transistor M4" is turned on when the scan signal is supplied to the $(n-2)^{th}$ scan line Sn−2.

In the pixel according to the third embodiment of the present invention, the third transistor M3" and the fourth transistor M4" are coupled to the $(n-2)^{th}$ scan line Sn−2 instead of the control line CLn. In this case, the scan signals supplied to the scan lines S1 to Sn are set to have a period of 2H.

In one embodiment of the present invention, the width of the scan signals are set to have a period longer than 3H such that the threshold voltage compensation period of the second transistor M2 can be controlled. In more detail, in one embodiment of the present invention, the scan signals may be set to have a period of k (k is a natural number higher than 2) horizontal periods. In this case, when the first transistor M1 is coupled to the $n^{th}$ scan line Sn, the third transistor M3" and the fourth transistor M4" are coupled to an $(n-k)^{th}$ scan line Sn-k. The light emission control signal supplied to the $n^{th}$ light emission control line En is partially overlapped with the scan signal supplied to the $(n-k)^{th}$ scan line Sn-k and is completely overlapped with the scan signal supplied to the $n^{th}$ scan line Sn.

Figure 9:
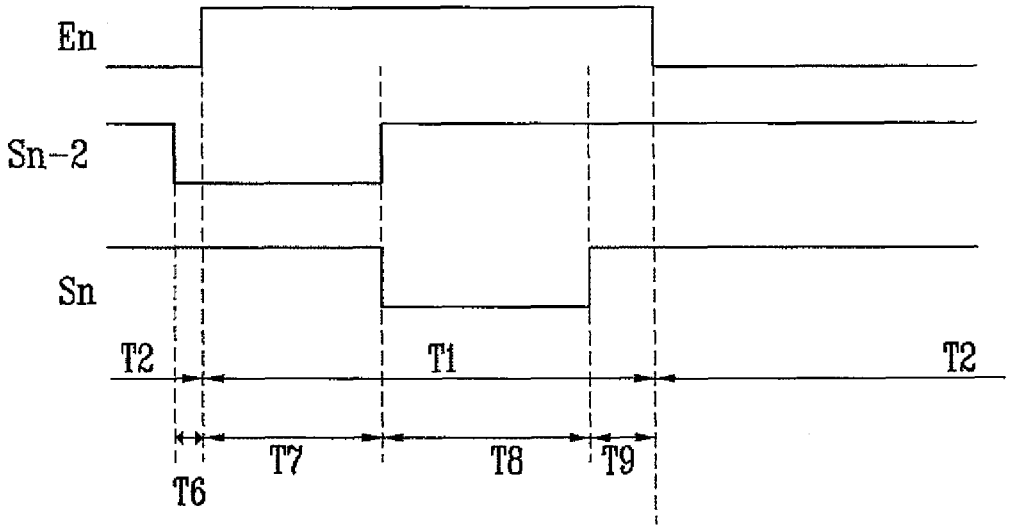
FIG. 9 is a timing diagram illustrating a method of driving the pixel of FIG. 8.

FIG. 9 is a timing diagram illustrating a method of driving the pixel of FIG. 8. In FIG. 9, the first period T1 is divided into a seventh period T7, an eighth period T8, and a ninth period T9. A period immediately before the first period T1 (for example, a period less than 1H) is set to as a sixth period T6.

Referring to FIG. 9, the scan signal is supplied to the $(n-2)^{th}$ scan line Sn−2 for the sixth period T6. When the scan signal is supplied to the $(n-2)^{th}$ scan line Sn−2, the fourth transistor M4" and the third transistor M3" are turned on.

When the fourth transistor M4" is turned on, the voltage of the reference power source Vref is supplied to the first node N1. When the third transistor M3" is turned on, the second transistor M2 is coupled in the form of a diode. Here, since the fifth transistor M5 maintains the turned-on state for the sixth period T6, the voltage of the second node N2 is initialized to approximately the voltage of the second power source ELVSS. The sixth period T6 is set to as a period less than 1H such that a sufficient compensation period of the threshold voltage can be secured.

The light emission control signal is supplied to the light emission control line En for the seventh period T7, and the fifth transistor M5 is turned off. When the fifth transistor M5 is turned off, the voltage in which the threshold voltage of the second transistor M2 is subtracted from that of the first power source ELVDD is applied to the second node N2. At this time, the first capacitor C1 stores the voltage corresponding to the voltage difference between the first node N1 and the second node N2, that is, the threshold voltage of the second transistor M2. Here, since the sixth period T6 is set to as a period less than 1H, the seventh period T7 is set to as a period exceeding 1H.

In the eighth period T8, the supply of the scan signal to the $(n-2)^{th}$ scan line Sn−2 is stopped, and the scan signal is supplied to the scan line Sn. When the supply of the scan signal to the $(n-2)^{th}$ scan line Sn−2 is stopped, the third transistor M3" and the fourth transistor M4" are turned off. When the scan signal is supplied to the $n^{th}$ scan line Sn, the first transistor M1 is turned on.

When the first transistor M1 is turned on, the data signal is supplied from the data line Dm to the first node N1. The voltage of the first node N1 is lowered down from the voltage of the reference power source Vref to the voltage of the data signal, and then the second capacitor C2 stores the voltage corresponding to the data signal.

The supply of the scan signal to the $n^{th}$ scan line Sn is stopped for the ninth period T9, and the first transistor M1 is turned off. The first capacitor C1 and the second capacitor C2 maintain the voltage stored in the previous period for the ninth period T9.

After that, the light emission control signal is not supplied to the light emission control line En for the second period T2, and then the fifth transistor M5 is turned on. When the fifth transistor M5 is turned on, the second transistor M2 supplies the current corresponding to the voltages stored at the first and second capacitors C1 and C2 to the OLED.

The present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device comprising:

a scan driver for sequentially supplying scan signals to scan lines and for sequentially supplying light emission control signals to light emission control lines, each of the scan signals having a duration longer than or equal to k horizontal periods and each of the emission control signals having a duration longer than that of a corresponding one of the scan signals;

a data driver for supplying data signals to data lines, the data signals being synchronized with the scan signals; and pixels at crossing regions of the scan lines and the data lines;

wherein an $i^{th}$ pixel of the pixels comprises:

an organic light emitting diode having a cathode electrode coupled to a second power source;

a second transistor for controlling an amount of current flowing from a first power source to the organic light emitting diode, the first power source being coupled to a first electrode of the second transistor;

a first capacitor having a first terminal coupled to a gate electrode of the second transistor;

a first transistor coupled between a second terminal of the first capacitor and the data line, the first transistor being configured to turn on when a first scan signal of the scan signals is supplied to an $i^{th}$ scan line of the scan lines;

a third transistor coupled between a gate electrode and a second electrode of the second transistor, the third transistor being configured to turn on when a second scan signal of the scan signals is supplied to an $(i-k)^{th}$ scan line of the scan lines; and a fifth transistor coupled between the second electrode of the second transistor and the organic light emitting diode, the fifth transistor being configured to turn off when a light emission control signal of the light emission control signals is supplied to an $i^{th}$ light emission control line of the light emission control lines, wherein the light emission control signal supplied to the $i^{th}$ light emission control line is at least partially overlapped with the second scan signal supplied to the $(i-k)^{th}$ scan line and is completely overlapped with the first scan signal supplied to the $i^{th}$ scan line, wherein k is a natural number that is greater than or equal to 2.

2. The organic light emitting display device as claimed in claim 1, further comprising:

a fourth transistor coupled between a reference power source and the second terminal of the first capacitor, the fourth transistor being configured to turn on when a control signal is supplied to an $i^{th}$ control line; and a second capacitor coupled between the second terminal of the first capacitor and the first power source.

3. The organic light emitting display device as claimed in claim 1, wherein the light emission control signal supplied to the $i^{th}$ light emission control line is supplied after the second scan signal is supplied to the $(i\text{-}k)^{th}$ scan line.

4. The organic light emitting display device as claimed in claim 1, wherein the scan signal supplied to the $i^{th}$ scan line is overlapped with the light emission control signal supplied to the $i^{th}$ light emission control line.

5. The organic light emitting display device as claimed in claim 1, wherein the scan signal supplied to the $i^{th}$ scan line is supplied after the light emission control signal is supplied to the $i^{th}$ light emission control line.

6. The organic light emitting display device as claimed in claim 1, wherein the data driver is configured to supply a data signal corresponding to left data for a first frame period, first black data for a second frame period, right data for a third frame period, and second black data for a fourth frame period.

7. The organic light emitting display device as claims in claim 1, wherein the fifth transistor is configured to turn off after the third transistor is turned on.

8. The organic light emitting display device as claims in claim 1, further comprising a second capacitor coupled between the second terminal of the first capacitor and the first power source.

* * * * *